US005088377A

United States Patent [19]

Delecaris

[11] Patent Number: 5,088,377

[45] Date of Patent: Feb. 18, 1992

[54] HI-HAT CYMBAL CARRIER AND PROTECTOR

[76] Inventor: Frank A. Delecaris, 225 W. 124th St., Kansas City, Mo. 64145

[21] Appl. No.: 639,187

[22] Filed: Jan. 9, 1991

[51] Int. Cl.[5] ..... G10D 13/02

[52] U.S. Cl. ..... 84/422.3; 206/303; 206/314

[58] Field of Search ..... 84/411 R, 421, 422.3, 84/453; 206/303, 314, 521, 523

[56] References Cited

U.S. PATENT DOCUMENTS

| | | | |
|---|---|---|---|
| 501,318 | 7/1893 | Boulanger | 206/314 X |
| 2,601,426 | 6/1952 | Baumann | 206/349 |
| 4,386,702 | 6/1983 | Schultz et al. | 206/523 |
| 4,892,193 | 1/1990 | Thomas | 206/453 |

OTHER PUBLICATIONS

Advertisement for "Artisitic Cymbal Bags", p. 6 of Avedis Zildjian Cymabls Catalog, 1963.

*Primary Examiner*—L. T. Hix
*Assistant Examiner*—Howard B. Blankenship
*Attorney, Agent, or Firm*—Thomas M. Scofield

[57] ABSTRACT

Containers for receiving, holding and transporting a pair of drummer's cymbals from a hi-hat stand; containers for receiving, holding and transporting large diameter circular, sectionally arcuate objects in pairs such as musical cymbals of identical diameter taken from a hi-hat stand; receiving, containing and carrying containers for two paired, opposed cymbals taken from a hi-hat cymbal stand; containers adapted to receive, hold, contain and protect a pair of opposed, equal diameter cymbals actually mounted on a hi-hat cymbal stand, the containers not only holding and carrying the cymbals therewithin, but also transportable and carryable with the hi-hat stand, per se.

9 Claims, 2 Drawing Sheets

Fig. 5.
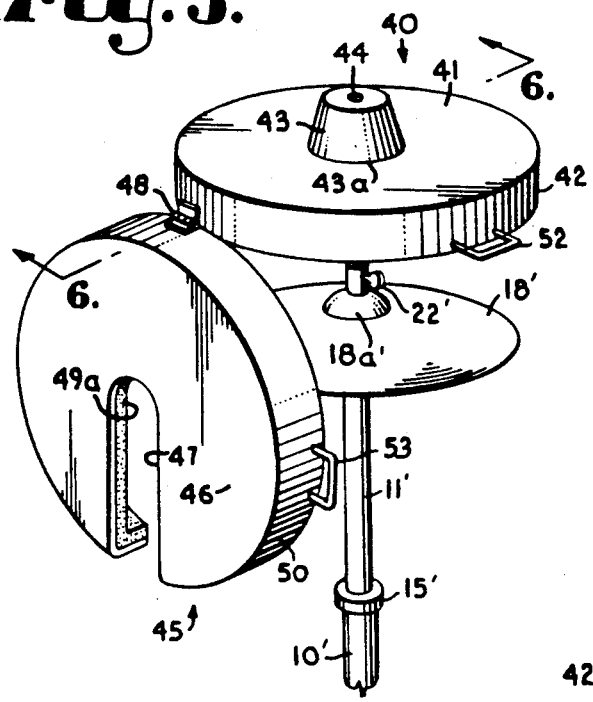
Fig. 8.
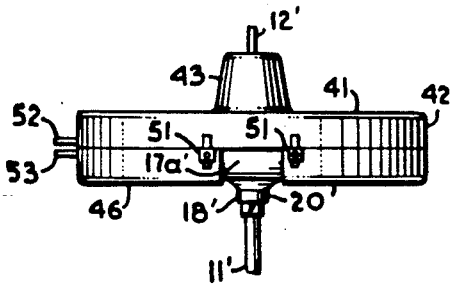
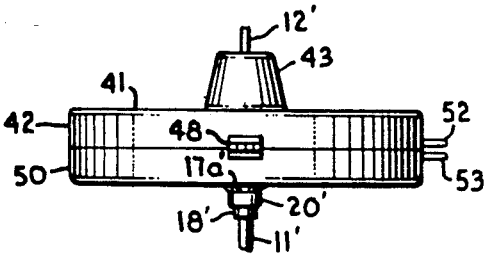
Fig. 9.
Fig. 6.
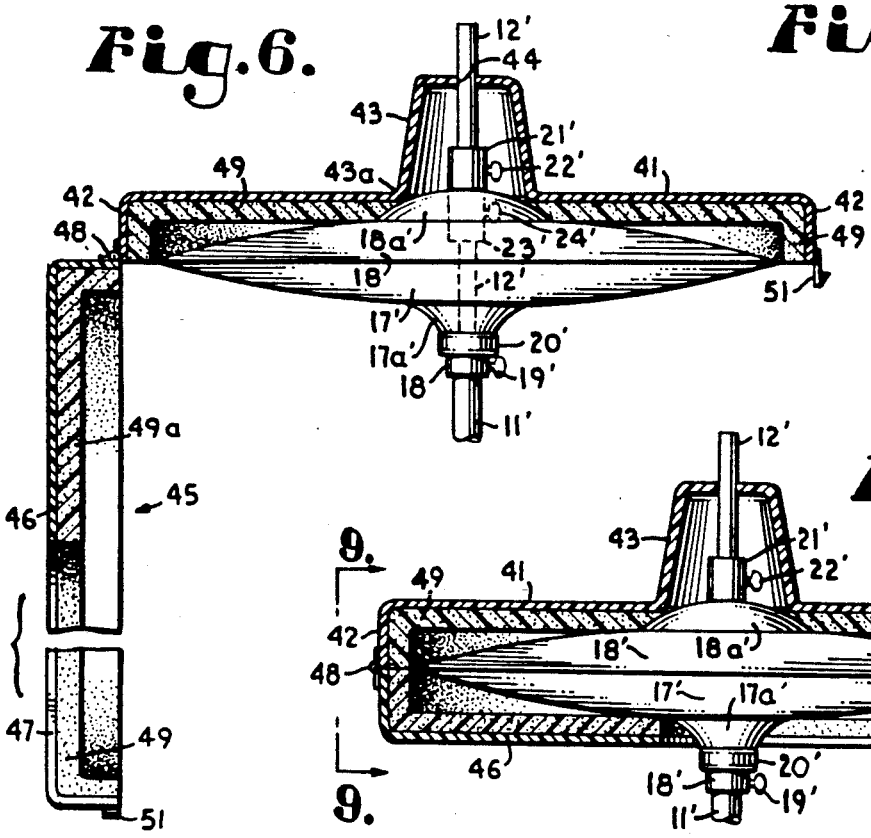
Fig. 7.
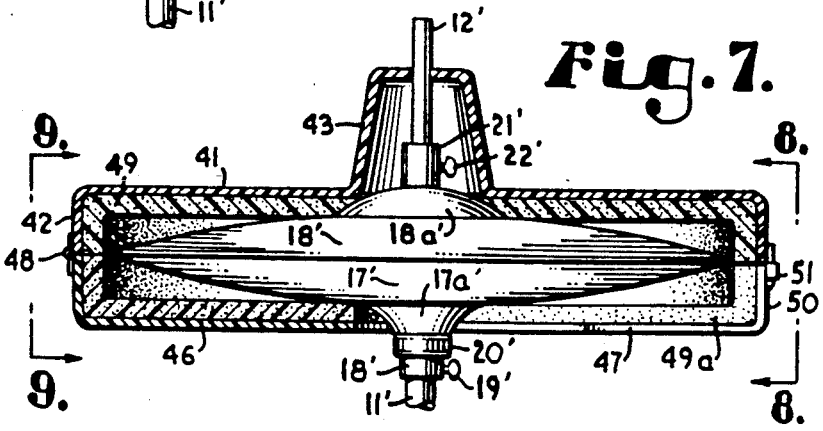

HI-HAT CYMBAL CARRIER AND PROTECTOR

BACKGROUND OF THE INVENTION

Drummers in bands and musical organizations typically utilize, in their working set-ups, numerous cymbals, a number of which are each singly mounted on stands positioned around the drummer's position and his/her drum array so as to be reachable by the drummer with his/her drumsticks. These are free, single disk or hat cymbals which are individually struck by the drummer's drumstick as needed. This type of cymbal is not the subject of the present invention. Secondly, and this is the subject of the present invention, there is the "Hi-Hat" cymbal system, device, machine and construction involving opposed, upwardly and downwardly facing cymbal disks or hats. The latter are clashed together by the action of the drummer's foot which typically works a pedal connected to a central, relatively small diameter shaft on which the upper cymbal is mounted. This shaft is normally spring-loaded upwardly free of the lower cymbal. The latter, the lower cymbal, is mounted on an elongate vertical tube containing the first shaft which reciprocates up and down therewithin as the drummer works his art. Drummers adjust the distance apart of the upper, downwardly facing cymbal and the lower, upwardly opening or facing cymbal according to their own preference, say, from extremely close to quite a substantial clearance.

Even laymen, inspecting cymbals or viewing the cymbal arrays in publications such as "Modern Drummer" can see that they are quite vulnerable and easily prone to damage. Cymbals may be injured or destroyed not only from use and/or misuse, but also from clumsy handling. They are very fragile, as can be clearly seen from their structure.

When the program for the day, evening or night has been concluded, it is necessary that the cymbals (all of them, but here referring particularly to those in the hi-hat stand array) must be removed from their stands and protected until the next program or prepared for transportation. With respect to the hi-hat stand with the cymbals thereon, the drummer must remove the two cymbals, with all the trouble that entails and place them into some sort of protective container. After the move, (or merely the enclosure overnight), the two cymbals must again be refitted on the vertical outer tube and inner rod, respectively, and once again spaced apart the correct distance from one another. This involves, typically, a large effort, problem and trouble daily and further may involve various actual and potential logistic problems and difficulties which often may result in cymbal damage.

What is needed is a suitable, unique container which can receive, enclose, protect and contain both cymbals of the hi-hat system under two circumstances. The first of these is where the cymbals have been removed from the hi-hat device. This is important although it involves the efforts of removal of the cymbals from the device and return thereto. The second of these is that the container be such that it can be used to enclose, receive, hold and protect the cymbals actually on the hi-hat system. One container should be able to form both these functions.

It should be understood in the above and the following that nothing whatsoever is done to change the structure and function of the basic hi-hat design, device, structure or mechanism. This device and the cymbals themselves mounted thereupon are old in the art and not part of the instant invention.

BRIEF DESCRIPTION OF THE INVENTION

The subject invention, development and improvement involves the provision of containers which, at least substantially, enclose two opposed cymbals in the position they normally assume on a hi-hat stand. Such containers are first adapted to receive, hold, protect and carry two oppositely positioned cymbals, per se, independent of the hi-hat stand and, secondly, are adapted to engage, enclose, contain and hold the cymbals on the hi-hat stand so as to be transported therewith with the hi-hat stand as it is itself moved from place to place.

The container/enclosure may be provided with a top or upper dome to enclose all of the upper part of the top cymbal engagement except for the uppermost end of the central top cymbal carrying shaft. Alternatively, such dome may be removed, giving access to the top cymbal engagements.

The preferred form of the subject container, enclosure or cymbal holder involves a pair of 180° arc half cylinders with upper and lower walls and a side wall, such half cylinders pivoted to one another at one side edge and end of each, there being a fastening engagement provided on the other, opposite side edges and ends. Suitable foam rubber or plastic containment and surrounding for the cymbals within the container, when closed, is provided, thus to prevent and minimize an impact or pressure injury.

THE PRIOR ART

Applicant is aware of the following patents involving containers, cases, protective devices, packing boxes and packaging systems:

Boulanger U.S. Pat. No. 501,318 "Drum Case", patented July 11, 1893;

Baumann U.S. Pat. No. 2,601,426 "Protective Device", issued June 4, 1952;

Schultz, et al U.S. Pat. No. 4,386,702, issued June 7, 1983 for "Molded Foam Plastic Plate Packing Box"; and Thomas U.S. Pat. No. 4,892,193, issued Jan. 9, 1990 for ". . . Packaging System For . . . Planar Objects"

OBJECTS OF THE INVENTION

A first object of the invention is to provide new types of container for removably receiving relatively fragile, flat or arched cylindrical and or circular objects.

Another object of the invention is to provide easily applicable and easily removable containers and holders for circular and perhaps sectionally arcuate constructions such as drummer's cymbals.

Yet another object of the invention is to provide containers which are adapted to removably receive therewithin a pair of oppositely facing drummer's cymbals, such cymbals either free from any support or actually in place on a stand such as a hi-hat cymbal stand.

Still another object of the invention is to provide cases, casings, housings, or containers adapted to removably receive, hold and enclose a pair of oppositely facing, peripheral edge contacting, matching cymbals of the sort normally employed on a conventional hi-hat drummer's stand, one of the said containers, cases, casings, or housings (preferred form) being in the form of a pair of hinged, shallow, half-cylinders, the latter provided with a latch mechanism opposite a hinge connecting said pair and having openings at the centers thereof whereby to be able to receive therethrough the lower and upper portions of the hi-hat stand.

Another object of the invention is to provide reusable containers for large diameter, semi-flat round members, such as drummer's cymbals, where the containers each have two halves hinged at one side and to one another, such openable to be able to be placed under and over or on each side of the cymbals or other objects and a hinge or latch is provided on the opposite ends or sides of the two halves of the containers.

Other and further objects of the invention will appear in the course of the following description thereof.

THE DRAWINGS

In the drawings, which form a part of the instant specification and are to be read in conjunction therewith, an embodiment of the invention is shown and, in the various views, like numerals are employed to indicate like parts.

FIGS. 1–4, inclusive show a first, preferred form of the subject hi-hat system cymbal containers.

Figure 1:
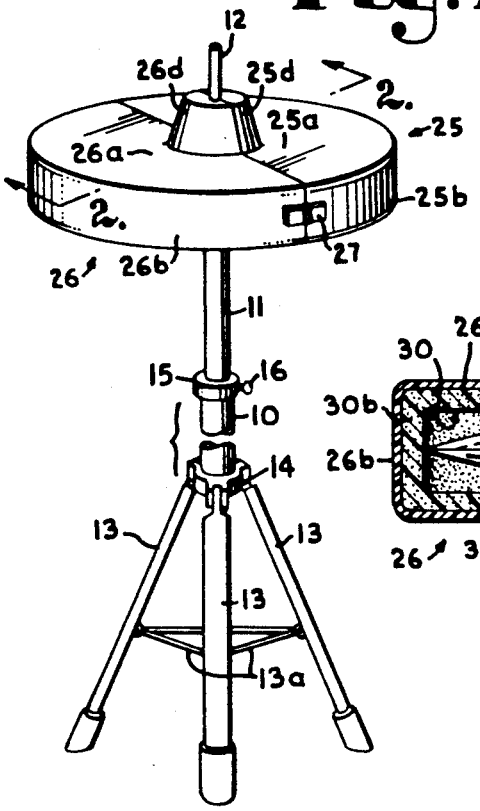
FIG. 1 is a three-quarter perspective view from above of a conventional hi-hat stand carrying cymbals (the cymbals not visible in the view), there being received on the upper part of the hi-hat stand and over, under and around the cymbals the subject inventive container or casing for the cymbals.
Figure 2:
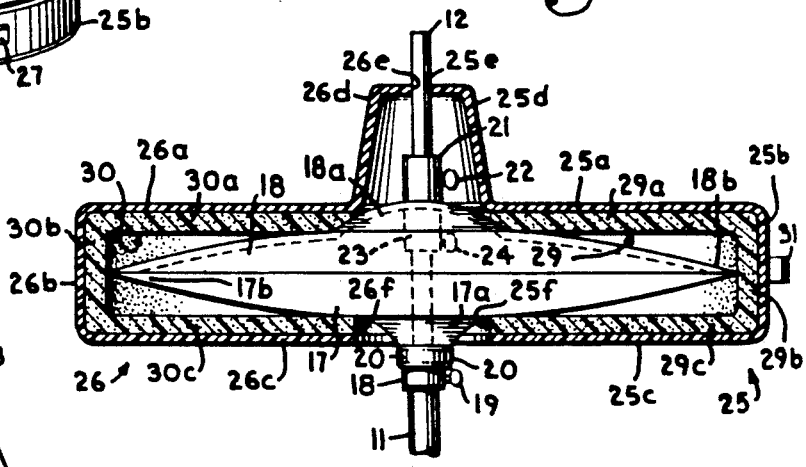
FIG. 2 is a view taken along the line 2—2 of FIG. 1 in the direction of the arrows.
Figure 3:
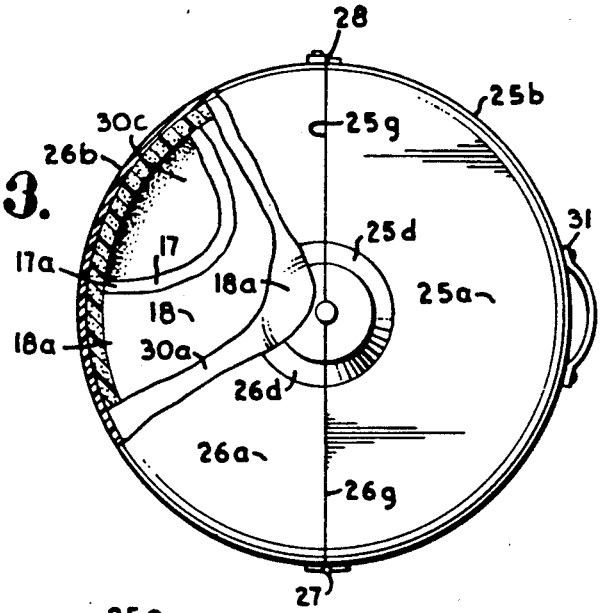

FIG. 3 is a top view of the device of FIGS. 1 and 2 with portions cut away to better illustrate the construction therewithin, the levels of structure shown, taken from the right hand side of the view to the left being: the top of the closed container, a portion of the top cymbal, a portion of the lower cymbal, a portion of the foam plastic liner and, finally, the upper side of the bottom wall of the container.

Figure 4:
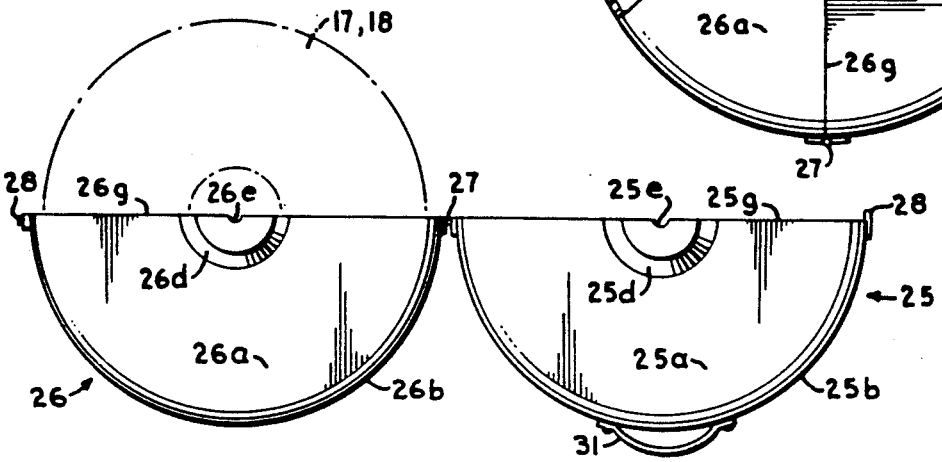

FIG. 4 is a top view of the container device seen in the previous figures with the device fully opened showing the hinged, opposed half cylinders and, in the left-hand half cylinder, at the top of the view, a showing of half of a cymbal in outline.

FIGS. 5–9, inclusive show a second, variant form of the subject hi-hat system cymbal containers.

FIG. 5 is a fragmentary perspective view from above of the upper part of a hi-hat cymbal suspension system with the second form of the subject cymbal container being or in the process of being applied to the cymbals on the hi-hat suspension system.

FIG. 6 is a view taken along the line 6—6 of FIG. 5 in the direction of the arrows, but with the top portion of the container lowered onto the uppermost rod of the hi-hat system with the uppermost portion of the second type of container resting on the upper cymbal.

FIG. 7 is a view like that of FIG. 6, but with the lower portion of the cymbal container closed upperwardly around the bottom cymbal of the pair of such mounted on the hi-hat system of FIG. 6, the lower portion so pivoted being seen in the left hand side of FIG. 6.

FIG. 8 is a view taken along the line 8—8 of FIG. 7 in the direction of the arrows.

FIG. 9 is a view taken along the line 9—9 of FIG. 7 in the direction of the arrows.

STRUCTURE AND FUNCTION (FIGS. 1–4, INCLUSIVE)

Referring to FIG. 1, as previously noted, therein is shown a perspective view from above of a conventional hi-hat stand carrying cymbals (the cymbals not visible in the view), there being received on the upper part of the hi-hat stand as well as over, and around the cymbals, the subject inventive container or casing for the cymbals. It has also been noted that the conventional hi-hat cymbal stand comprises no part of the instant invention.

In point of fact, there is only a fragmentary showing of the hi-hat cymbal stand in FIG. 1, sufficient to show that the device comprises a first, lower, vertical collar or sleeve 10 within which is slideably received a second, lesser diameter, vertical collar or sleeve 11 and, yet further, an elongate, vertical, typically steel rod or shaft 12 which extends upwardly above the top of sleeve 11 and downwardly at least somewhat below the lower end of sleeve 10. Below sleeve 10, the lower end of rod or shaft 12 is pivotably connected to the foot pedal (not seen) of the hi-hat system or device, whereby rod 12 may be reciprocated upwardly and downwardly within sleeves 11 and 10 to clash the cymbals together and then free them, one from the other, respectively.

A plurality of support legs 13 are pivotably mounted at their upper ends by collar 14 on sleeve 10, there being a set screw (not seen) that fixes the vertical position of collar 14 on sleeve 10 when the legs 13 are projecting at their proper angle. Braces **13*a* are pivotably connected to the bottom of sleeve 10 at their inner ends and likewise pivotably connected to legs 13** at their outer ends.

The adjustment of height of the device is basically by virtue of collar 15 having set screws 16 thereon by virtue of which sleeve 11 may be raised out of sleeve 10 or lowered thereinto.

As noted, all of this just described construction is entirely conventional and may appear in somewhat different form and relationship with respect to particular hi-hat systems and devices fabricated by particular manufacturers. Rod 12 is spring-loaded with respect to sleeve 10 in its connection to the operating pedal (not seen) so that the cymbals, once spaced apart to the distance a particular drummer desires, will naturally return to that spacing when the operating pedal is not employed.

FIG. 2 shows an enlarged detail of the top end of the device just described of FIG. 1. Rod 12 is shown as slideably received and reciprocable within sleeve 11. A first conventional cymbal 17 is shown supported at the upper end of sleeve 11 by collar 18 having set screw 19 and washer 20. The upper cymbal 18 is shown resting on the periphery of lower cymbal 17 with its own peripheral under edge. This means that either (1) the operating pedal has been depressed sufficiently to bring the upper cymbal, fixed in vertical position on rod 12, down into contact with lower cymbal 17 or (2) that the means normally fixing the vertical position of upper cymbal 18 on rod 12 have been loosened to permit cymbal 18 to slide down rod 12 into contact with lower cymbal 17 and then fixed in place for carrying or covering as will be described. The latter option is preferred as, if the cymbals are kept in contact by continuous depression of the operating pedal and capture of the cymbals in the container to be described, then the normal spring-loading keeping the upper cymbal apart from the lower cymbal to enable use of the cymbals in playing music is affected by long term stretching of the spring-loading coil on rod 12, which is not desirable.

At any rate, referring to FIG. 2, there is positioned above upper cymbal 18, on rod 12, collar 21 having set screw 22. Below cymbal 18, on rod 12, there is positioned second collar 23 with set screw 24. When cymbal 18 is down in contact with cymbal 17, as seen in FIG. 2, collar 21 fixed on rod 12 holds cymbal 18 in the down position. On the other hand, when cymbal 18 is spaced upwardly on rod 12 from the position of cymbal 17 on collar 20, it is collar 23 fixed on rod 12 that holds cymbal 18 up, giving the necessary clearance.

Both cymbals have central openings (not seen) that are large enough to permit them to slide up and down on rod 12, but not of great enough diameter to fit over tubing or sleeve 11.

All of the above has been a description of a long known, long commercial, long used and practiced cymbal playing device, specifically, the hi-hat system. A very clear overall photograph of a typical hi-hat system is found at Page 41 of the June, 1990 "Modern Drummer", Modern Drummer Publications, 870 Pompton Avenue, Cedar Grove, New Jersey 07009. The device in question illustrated is sold by Drum Workshop, Inc., 2697 Lavery Court, Unit 16, Newbury Park, California 91320, the specific device illustrated being designated "DW5500 Turbo Hi-Hat Stand". This background disclosure is herein incorporated in this Specification solely to show the structure of a typical and conventional hi-hat cymbal stand.

Now turning to the subject improvement, of these figures such comprises a receiving and confining container or enclosure for the two cymbals of a hi-hat system such as those seen at 17 and 18 in FIG. 2. The device comprises a pair of squat or low half cylinders generally designated 25 and 26. The half cylinders are symmetrical with respect to depth, diameter and radius, as well as height. Half cylinder 25 has top wall 25*a*, sidewall 25*b* and bottom wall 25*c*. Element 25 optionally also has half frusto-conical dome 25*d* with half arcuate opening 25*e* centrally of the top thereof. Yet further, half arcuate opening 25*f* is provided in the center of lower side 25*c*.

The opposite, symmetrical, semi-congruent half of the container 26 has top wall 26*a*, bottom wall 26*c*, sidewall 26*b*, half dome 26*d*, top central half opening 26*e* and lower central enlarged half opening 26*f*. A hinge 27 pivotably joins one set of ends of vertical wall portions 25*b* and 26*b* to enable either positioning the half cylinders 25 and 26 in the closed position of FIGS. 1-3, inclusive or in the fully open position seen in FIG. 4. A detachable clasp or closure 28 seen in open position at the left and right-hand sides of FIG. 4 and closed position at the top of FIG. 3, is provide to enable the closing and locking of the two pivoted halves of the cylindrical container: (1) with respect to itself, empty, so as to be able to have the container fixed shut or openable; (2) with respect to a pair of cymbals which remain mounted on the hi-hat stand as seen in FIGS. 1 and 2 and (3) with respect to a pair of cymbals removed from the hi-hat stand to be received within the container and moveable around independent of the hi-hat stand.

The cylinder half 25 is lined as at 29 with (1) normally horizontal top sheet 29*a* of rubber or foam plastic, (2) the preferably continuous, normally vertical, peripheral inner wall of portion 29*b* thereof and (3) the bottom wall portion 29*c* thereof, such preferably continuous with portion 29*b*. This foam plastic or foam rubber, real or synthetic, is permanently fixed or glued to the inside surface of half cylinder 25 from the upper and lower inner edges 25*g* best seen in FIGS. 3 and 4. The inner edge 25*g* in top wall 25*a* includes dome 25*d*. The inner edge 25*g* of lower wall 25*c* includes opening or half opening 25*f*.

Now looking at the other half of the container, section 26, inner edges 26*g* are provided which, with respect to upper face 26*a* cuts dome 25*d* and opening portion 26*e*. On the underside or under wall 26*c* of section 26, the inner edge line 26*g* cuts opening 26*f*.

The purpose of opening 25*e*, 26*e* is to enable the uppermost portion of rod 12 to extend therethrough. The purpose of opening 25*f*, 26*f* is to enable dome 17*a* of cymbal 17 to extend therethrough. Likewise, the purpose of dome 25*d* is to enable the extension therein to of the center upper portion of dome 18*a* of cymbal 18 and collar 21 as well as set screw 22.

Looking at the inner wall portion of section 26 of the container, the inner or underside of top wall 26*a* receives continuous half circle sheet 30*a* of real or synthetic rubber (foam) or synthetic foam plastic. This is relieved centrally with respect to dome portion 26*d*. Preferably continuous therewith is vertical, 180° arc wall portion 30*b* of like material. The upper face of bottom wall 26*c* is covered by half circle, centrally relieved (for opening 26*f*) foam rubber or foam plastic sheet 30*c*. Sheets 30*a*, 30*c* and 29*a*, 29*c* extend to the edge walls 26*g* and 25*g*, respectively, save where relieved for the openings and domes.

It may be seen that the periphery of the cymbal domes 18*a* and 17*a* abut, contact and compact against the foam rubber or plastic sheets. Additionally, circumferentially, the cymbal circular peripheral edges 18*b* and 17*b* extend into contact and typically somewhat compress the vertical foam plastic walls 30*b* and 29*b* circumferentially of the self-contacting cymbal edges.

In operation, as stated above, several different conditions can occur with respect to use of the subject device. In any case, one usually starts with the container empty and closed upon itself by fastener 28. A carrying handle 31 (FIGS. 3 and 4) is preferably and typically provided, riveted or otherwise attached to the periphery of one of the container halves, here shown on the peripheral wall portion 25*b* of section 25 of the container. A like handle could be placed on the arcuate sidewall of section 26 in place of handle 31 or in addition thereto so that two opposed handles would be provided for use. Such handle or handles preferably are positioned half way round the 180° sidewall of the section sections carrying the handle(s), thus at the 90° mark centrally at the handle. The presence of one or more handles on the sidewall of the shell portions of the container may also aid the opening and closing of the container shell portions with respect to cymbals received therewithin.

Given the closed, latched, empty container, when the drummer is ready to end play for the night, day or program, the cymbals are prepared for encasement in the container. Two preferred means of doing this are available. One of these is to remove cymbals 18 and 17 from rod 12 by first lifting off collar 21 from the rod, then taking cymbal 18 off the rod, then sliding collar 23 upwardly off top end of the rod, followed by cymbal 17. This gives the free cymbals to be inserted into the container. Before or after the latter is done, collars 23 and 21 are reinserted on rod 12 and locked down with respect to washer 20 and collar 18.

FIG. 4, left side, the stacked cymbals 17, 18 are shown in dotted lines inserted for half their diameter into container section 26. Once this is done, in the view of FIG. 4, the section 25 is moved in a counter-clockwise direction over the outwardly extending portions of the cymbals 17 and 18 and into a position where end edges 26*g* and 25*g* abut one another. Latch 28 or the elements thereof are joined and thus the container closed and locked. The two cymbals can then be carried from place to place and stored in the closed container until ready to return same to position on the hat stand.

The second option is where the cymbals are mounted on rod 12 with dome 17*a* of cymbal 17 resting on washer 20 above collar 18 and cymbal 18 spaced upwardly away from cymbal 17 by virture of collar 23 engaging shaft or rod 12 at a given height above the top edge 17*b* of cymbal 17. There must be enough clearance that set screw 24 can be reached by the hand of the drummer or assembler. The cymbal tilts somewhat. Alternatively, collar 21 is taken off rod 12, cymbal 18 lifted to a sufficient height and collar 23 fixed at the desired height on rod 12. When this is done, the cymbal 18 is lowered onto the top of collar 23 and collar 21 lowered down above the cymbal and locked in place by set screw 22.

To collapse the cymbals to the position of FIG. 2, set screw 24 is loosened enough that collar 23 can drop on shaft 12 past the point where the cymbal peripheral edges 17*b* and 18*b* abut one another. At that point, collar 21 is lowered to the position of FIG. 2 and fixed on rod 12 to keep the cymbals tightly together.

At this point, the container is applied to the locked together cymbals (as seen in FIG. 2) in the manner seen in FIG. 4 with either section 25 or 26 engaging half the diameter of the cymbals and then the other portion closed therearound.

The reason that collar 23, which, in the last described option, would typically slide down into the bowl or dome 17*a* of cymbal 17 is shown up in place in FIG. 2 is the following, not preferred, but useable option.

That is, the top cymbal 18 is lowered into peripheral edge contact with lower cymbal 17 by virture of the drummer or operator stepping on the foot pedal and drawing down rod 12 against its spring-load with respect to sleeves 10 and 11. In this case, with cymbal 18 still fixed in operating position by sleeves 21 and 23, the drummer or operator may encase the self-contacting cymbals by the hinged case 25, 26 in the manner previously described and lock the case closed. Then the drummer/user may take his foot off the pedal and the compression of the spring-load is taken up in the abutment of the two cymbals against the foam lining of the container.

In the latter two described manners, the container, locked on the cymbals on the hat stand as seen in FIG. 1 and FIG. 2, may be carried around with the hat stand. This mode of storage is convenient in that only the hat stand need be carried and the container will go on along therewith. Thus the drummer has one hand free for other material. If the separate cymbals are in the container and the hat stand is collapsed upon itself in conventional manner for storage or carrying, then, typically, two hands must be employed to carry the assembly.

FIG. 5-9, INCLUSIVE—STRUCTURE AND FUNCTION

In the views of FIGS. 5-9, inclusive of the second sheet of drawings of this case, there is shown the application to a hi-hat cymbal mounting, carrying and using system of a second type of safety container for the paired cymbals. This second type of container can also be used to merely carry the paired cymbals themselves, as is the case with the first, preferred, cymbal enclosure, protector and carrier.

Since all of the parts of the hi-hat system shown in these views are the same or identical to the equivalent parts in FIGS. 1-4, inclusive, all of these parts are numbered the same, but primed. The function and operation of all these parts is identical with the function and operation of same previously described with respect to the first container.

The construction of the container of FIGS. 1-4 which involves a horizontal or normally horizontal opening and closing action, with the two parts of the cylindrical container body horizontally hinged with respect to one another at 27, contrasts sharply with the structure and opening and closing action of the container of FIGS. 5-9, inclusive. The latter structure and action is precisely opposite that of the preferred container form. That is, there are two fully circular and fully cylindrical or near cylindrical halves of the device vertically hinged with respect to one another on one lower/upper edge portion thereof. This is best seen in FIGS. 5 and 6. The goals and purposes of each of the containers are precisely the same.

Now specifically looking at the structure of the second container and particularly referring first to FIGS. 5 and 6, the top half of the container, generally designated 40, has a typically and preferably flat circular upper surface 41. Fixed to the peripheral edge of disc 41 is peripheral, normally downwardly extending flange 42 which is of uniform length and extends preferably at right angles or normal to disc 41. A frusto-conical dome 43, analogous to that seen at 25*d* and 26*d* when the container of FIGS. 1-4, inclusive is closed, is optionally provided, in integral, monolithic form centrally of the disc or plate 41. This structure has opening 44 centrally of the top thereof to receive the top rod 12′ of the hi-hat system therewithin and therethrough as seen in detail in FIG. 6-9 inclusive. This structure, which encloses and overlies the upper cymbal securement 21′, 22′, 23′ and 24′ may be omitted and the opening through which the upper portion of the hi-hat securement system protrudes may be a larger circular opening defined by the base of portion 43 at 43*a*.

The underside and inside of upper closure portion 41, 42 (generally 40) is securely lined with foam rubber, foam synthetic rubber or foam plastic as at 49 of sufficient resiliency to enable the contacts of the cymbal portions therewith to compact and impress thereon, yet of sufficient structural strength and rigidity that resistance to crushing of the cymbal or any portion thereof through the padding against the harder cover portions 41 and 42 is prevented except in the most extraordinary circumstances.

Now particularly looking at the lower points of the views of FIGS. 5-9, inclusive or lower portion thereof, the lower closure member, generally designated 45, has bottom wall 46 thereof which is a circular disc of preferably precisely the same outer diameter as disc 41. A large radial slot 47 of length greater than the radius of the circle of disc 46 is seen at 47. This slot is of greater width than the diameter (see FIG. 7 working up from the bottom) of rod 11', collar 18' with set screw 19', collar 20 and central cymbal portion 17*a*. If this were not the case, closure could not be made from the position of FIG. 6, counterclockwise around the pivot of hinge 48 up to the position of FIG. 7 where the foam rubber, foam synthetic rubber, foam plastic, whatever 49*a* will bear against the lower outer face of cymbal 17' and somewhat against the hub 17*a'* of cymbal 17'. Incidentally, there is no particular significance in the differing forms of the hubs 18*a'* and 17*a'* seen in the two cymbals in the views of FIGS. 6 and 7, just as such is the case with respect to the hubs 18*a* and 17*a*. The cymbals' hubs may differ in construction or be the same so long as they are of the same diameter.

It is further pointed out that disc 46 has its own peripheral flange 50 extending normal thereto, preferably substantially the same distance as flange 42 from top disc 41. This enables symmetrical engagement of the two cymbals to symetrically enclose and safeguard the same.

The device of FIGS. 5-9, inclusive does have some problems with respect to the slot 47, which slot is absolutely necessary to permit the closure from the position of FIG. 6 to that of FIG. 7 including or passing by, in said closure, the elements previously noted seen at the bottom center of FIG. 7. Thus, a portion of the cymbal 17' is not enclosed or supported as is the case in the closure container of FIGS. 1-4, inclusive. This is both with respect to physical contact on the cymbal 17' from outside and exposure of the cymbal to the elements.

Finally, it may be seen that a pair of standard closures 51 (FIG. 8) are provided cooperating between flanges 42 and 50 adjacent the slot zone 47 (FIG. 8) to removably lock the clam shell closed members one upon the another.

Carrying handles 52 and 53 on flanges 42 and 50, respectively, may be provided to carry cymbals which have been removed from the hi-hat system. They are positioned 90° displaced from the slot zone 47 on either side thereof. This also places them opposite hinge 48 and fasteners 51:

The description of operations starting at the top of page 13 of the subject specification is the same for each container with respect to whether the containers are to be used on cymbals removed from the hi-hat system or cymbals remaining on the hi-hat system. In both cases, the cymbals and hi-hat system are treated the same. The only difference is in the manner of closure of the container on the cymbals, per se, or with the hi-hat system.

From the foregoing, it will be seen that this invention is well adapted to teach all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An enclosure for securing together and holding a pair of opposed, facing, hi-hat cymbals in face-to-face circumferential edge contact, comprising, in combination:

(1) a container having two essentially like, opposed, symmetrical mirror image halves, each with inner and outer sides thereto and moveable towards and away from one another to respectively enclose and then release said two facing cymbals, (2) a hinge hinging together said container halves at one juncture thereof for pivotal arcuate movement therearound with respect to one another, (3) a first one of said halves, when the two halves are opened around said hinge and substantially separated from one another, fittable over a substantial portion of the two, opposed, facing cymbals, (4) the other, second one of said halves fittable over the substantial remainder of the two said cymbals when closed around said hinge towards and against the said first container half, (5) the inner surfaces of each of said container halves substantially covered by a layer of cushioning material for engaging and protecting the outward surfaces and peripheral edges of said cymbals;

(6) openings in said container halves positioned substantially centrally of each one thereof operable to receive therewithin the usual, generally outwardly extending, central portion of the paired, facing cymbals, should such be present and (7) closure means on portions of each of said container halves spaced substantially away from said hinge operable to be engaged with one another when the two container halves are enclosing said cymbals and are closed against one another.

2. An enclosure as in claim 1 wherein the two container halves are hinged together for movement with respect to one another in a normally horizontal plane, each half thus comprising a 180° half disc of a 360° circle.

3. An enclosure as in claim 1 wherein the said two container halves are hinged for movement with respect to one another in a normally substantially vertical plane, there being an upper substantially circular disc and a lower substantially circular disc, the former adapted to substantially entirely overlie the top one of said two cymbals and the latter adapted to substantially entirely underlie the lower one of said two cymbals when enclosing same.

4. An enclosure for securing together and holding a pair of opposed, facing, hi-hat cymbals in face-to-face circumferential edge contact, comprising, in combination:

(1) a container having two essentially like, opposed, symmetrical mirror image halves, each half with inner and outer sides thereto, as well as inner and outer surfaces thereof, moveable towards and away from one another to respectively enclose and hold and move away from and release said two facing cymbals, (2) a hinge hinging together said halves at one juncture thereof, (3) a first one of said halves, when the two halves are open and substantially separated around said hinge from one another, fittable over a substantially 180° arc portion of the two, opposed, facing cymbals above the upper one of said cymbals and below the lower one of said cymbals, (4) the other, second one of said halves fittable over the substantial 180° arc portion remainders of the two said cymbals when moved around said hinge in a substantially horizontal plane and closed on and against the opposing edge of said first container half, (5) the inner surfaces of each of said container halves being substantially covered with cushioning material for engaging and protecting the outer surfaces and periphery of said two cymbals when the two halves of said container are closed upon one another, (6) openings in said container halves positioned substantially centrally of each one thereof operable to receive therewithin the generally outwardly extending central portions of the paired, facing cymbals, should such portions be present, and (7) closure means on end edge portions of each of said container halves substantially 180° opposed to the hinge thereon operable to be engaged and disengaged with one another when said two container halves are enclosing and closed upon said two facing cymbals and are closed against one another at facing central diametric edges thereof.

5. A device as in claim 4 wherein the openings in said container halves positioned substantially centrally of each one thereof are also operable to fit around and clear the central upper portions of the hi-hat support frame, whereby the said enclosure container may be applied to and fully enclose and hold said two cymbals while said two cymbals are positioned and closed face-to-face against one another on said hi-hat support frame.

6. An enclosure for securing together and holding a pair of opposed, facing, hi-hat cymbals in face-to-face circumferential edge contact, comprising:

(1) a container having two essentially like, opposed, symmetrical, mirror image halves, each said half having inner and outer sides thereto and inner and outer surfaces thereof and moveable towards and away from one another to respectively engage, enclose, hold and then move away from and release said two facing, contacting cymbals, (2) a hinge hinging together said halves at one edge juncture thereof, (3) A first one of said halves, when said two halves are open and substantially separated from one another, fittable down over the substantial entirety of the upper one of said two opposed, facing cymbals, (4) The other, second one of said halves then fittable upwardly under, yet over, the substantially entire lower portion of the lower one of said two cymbals and closeable on and against the said first container half overlying the first, upper cymbal, (5) the inner surfaces of each of said container halves being substantially covered with cushioning material for engaging and protecting portions of the outer surfaces of and the outboard peripheries of said cymbals, (6) openings in said container halves positioned substantially centrally of each one thereof operable to receive therewithin the generally outwardly extending central portions of the paired, facing cymbals, should such be present, (7) closure means on portions of each of said container halves positioned a substantial arcuate distance away from said hinge operable to be engaged with one another when said two container halves are enclosing said cymbals and are closed upwardly and downwardly against one another circumferentially.

7. A device as in claim 6 including means on said container halves for receiving therethrough portions of a hi-hat support frame adjacent the upper end thereof so that the cymbals may be enclosed while positioned on the hi-hat frame.

8. A device as in claim 7 wherein the lower container half has an elongate radial slot extending thereinto from the edge thereof opposite the position of the hinge.

9. A device as in claim 6 wherein the upper container half has a central raised portion with an opening through the center thereof to receive a portion of the hi-hat cymbal mounting construction therewithin.

* * * * *